US005829554A

United States Patent [19]

Benson et al.

[11] Patent Number: 5,829,554

[45] Date of Patent: Nov. 3, 1998

[54] HINGED MODULAR ELEVATOR CONTROL HOUSING

[75] Inventors: Thomas H. Benson; Marion R. England; David B. DeFrancisco, all of Russellville, Ark.

[73] Assignee: Innovation Industries Inc., Russellville, Ark.

[21] Appl. No.: 845,070

[22] Filed: Apr. 21, 1997

Related U.S. Application Data

[63] Continuation-in-part of Ser. No. 792,536, Jan. 31, 1997, Pat. No. 5,780,790, which is a continuation of Ser. No. 415,615, Apr. 3, 1995, abandoned.

[51] Int. Cl.[6] ..... B66B 7/00

[52] U.S. Cl. ..... 187/414; 187/395; 187/397

[58] Field of Search ..... 187/414, 395, 187/397, 391, 398, 399

[56] References Cited

U.S. PATENT DOCUMENTS

| | | | |
|---|---|---|---|
| 4,726,449 | 2/1988 | Orndorff et al. | 187/397 |
| 5,490,581 | 2/1996 | Warner et al. | 187/395 |

*Primary Examiner*—Kenneth Noland
*Attorney, Agent, or Firm*—Stephen O. Carver

[57] ABSTRACT

Modular elevator control housings having hinged faceplates that can be folded open to quickly expose the housing interior for service or modification. Each housing is generally in the form of a low profile, parallelepiped that is conveniently placed on a wall adjacent to an elevator car access position. The housing protectively encloses elevator operational controls, directional indicators, warning lights, or the like. The preferred housing comprises a chassis covered by a one-piece, folding faceplate interiorly hinged to the chassis that provides a display. The chassis comprises a subframe that secures the housing to the wall and a top and bottom cover. The subframe comprises a base bounded by integral, projecting side flanges that preferably terminate in upper lips. Extruded chassis sidewalls are secured to the subframe sides with fasteners captivated in part within captivating grooves defined in the sidewalls. Mounting grooves seat fasteners to secure the top and bottom covers to the sidewalls. In an alternative embodiment sliding grooves adjustably receive individual sliding display panels that jointly form the faceplate in cooperation with an adjacent folding panel. In the latter embodiment interior brackets secured to the subframe mount astragals that form a border between adjoining faceplate panels.

20 Claims, 8 Drawing Sheets

210
65
116
113
118
117
52
30
112
55
120
115
110B
60
116
111
201
112
202
49
203
212
90
204
3
70
177
211

HINGED MODULAR ELEVATOR CONTROL HOUSING

CROSS-REFERENCE TO RELATED APPLICATION

This application is a continuation-in-part of U.S. patent application Ser. No. 08/792,536 filed Jan. 31, 1997 now U.S. Pat. No. 5,780,790 that is in turn a continuation of prior Ser. No. 08/415,615, Filing Date: Apr. 3, 1995, now abandoned, entitled Modular Elevator Switch Control Housing, assigned to Group Art Unit 2111 Examiner R. Nappi, now abandoned.

BACKGROUND OF THE INVENTION

I. Field of the Invention

The present invention relates generally to elevator selection switch housings. More particularly, the present invention is primarily directed to modular elevator switch and control housings that can be either originally or retroactively installed to lower the physical height or position of elevator selection switches, controls, indicators or the like to enhance accessibility to the handicapped.

II. Description of the Prior Art

Elevators and their associated control housings are well known in the art. Elevator control housings are often conveniently placed upon building walls adjacent elevator doors. The control housings mount the passenger-activated selection switches, and protectively enclose the external switch wiring and circuitry.

Elevator controls typically comprise up and down indicator and selector buttons, direction indicators, warning lights and the like. So-called "master" or "fireman" key switches may be included. Typically, the housings also display informational material such as warnings, instructions, logo's, identifying indicia and the like. Displayed information often depends upon local regulations and building requirements well known in the art. The control housings mount the passenger-activated selection switches, and protectively enclose the wiring and circuitry.

Older elevator control housings typically located the elevator controls at average waist height or higher. However, with the passage of the Americans with Disabilities Act (ADA), it is now required that elevator controls be located within the immediate reach of handicapped individuals such as those seated in wheelchairs. The ADA regulations specify that elevator controls must be no higher than forty-two inches from the floor. Thus, it is now necessary to remodel or replace existing elevator control units to lower them to the required height.

A number of new ADA-compliant elevator control housings have been recently introduced. However, the known analogous structures have not solved all of the problems the new legislation has created. The internal components inside elevator control housings require regular and routine maintenance. It is often necessary to service only some of the internal components. However, the known prior art fails to anticipate the need for efficient service of these selected portions of the elevator control housings.

Several cities and states have also promulgated regulations dealing with elevators. These local regulations often require certain information to be displayed either on the housing or adjacent to the elevator. The known prior art does not provide a convenient method of manipulating housing covers to accommodate these various display requirements. Another problem is that with prior designs, certain wires sometimes had to be disconnected when light bulbs were changed.

Thus, it is desirable to provide an elevator control unit that replaces existing elevator controls without replacing existing control apertures or outlets. It is also desirous to provide a replacement control housing that utilizes existing elevator control apertures while simultaneously lowering the placement of the elevator controls.

Preferably, an improved housing would effectively lower the elevator controls at a minimal installation cost. Such an improved, replacement housing would need to be modular to speed installation and to accommodate various installation parameters.

A modular inner unit that accommodates various external displays while minimizing installation expenses is desirable. A modular elevator control housing would also need to permit selective access to the interior of the housing in an efficient manner, without requiring the disconnection of internal wiring for routine maintenance.

SUMMARY OF THE INVENTION

Our modular elevator control housing comprises an aesthetically pleasing, generally flat housing adapted to be mounted on a wall adjacent an elevator car entryway. The preferred embodiment comprises an elongated, single piece faceplate comprising a rigid, generally rectangular door panel. The latter panel is preferably hinged to the housing interior. The second embodiment of our housing includes a multi-piece faceplate, comprising a smaller, hinged door panel and one or more complimentary, sliding panels.

Each housing protectively encloses critical elevator call switches, indicators, displays, controls or the like. Both embodiments of our new housing may easily be retrofitted to replace existing control housings. Each easily mounts over an existing elevator control outlet, and each housing may be originally installed during building construction.

Each housing comprises an elongated, box-like chassis covered by the panel-like faceplate. The chassis comprises a generally rectangular supporting subframe that is flushly secured to the wall. Preferably, the subframe is bounded by integral, upturned flanges perpendicularly protruding from its flat base that provide convenient mounting slots for remaining components. The flanges terminate in upper lips that are parallel with the subframe base, and spaced apart from the wall.

Separate sidewalls are coupled to the subframe flanges. Top and bottom covers attach to the sidewalls over the ends of the subframe. The inner surfaces of the preferably extruded sidewalls define multiple, parallel channels or grooves. Captivating grooves torsionally lock fasteners that secure the sidewalls to the subframe flanges. Aligned sidewall sliding grooves are adapted to slidably receive individual display panels where necessary. Smaller mounting grooves seat appropriate fasteners (i.e., self tapping sheet metal screws) to secure the top and bottom covers to the sidewalls.

In the first embodiment the faceplate comprises a one-piece, outer panel hinged to the housing. This integral panel extends from the housing bottom all the way to the housing top, and it pivots outwardly about its hinge to provide access. This preferred faceplate panel is securely closed with either an access lock system or a tamper proof screw. Separate, sliding faceplate panels are not used in this arrangement. An internal hinge mounts the folding faceplate, which flushly abuts the subframe lips when correctly installed.

The alternative housing faceplate comprises a smaller, folding panel at the base that is hinged to the unit bottom. A selected number of smaller, slidably fitted panels cover the front to complete the display. When multiple faceplate panels are employed, it is preferred that mating clips or astragals supported by interior brackets separate abutting panels. The astragals include channels that seat edges of adjoining faceplate panels. The interior of the housing is easily serviced by opening the hinged faceplate. In one form of the invention the hinged faceplate panel is secured with a tamper-proof screw that allows controlled access; when the screw is removed the panel pivots open to expose the housing interior for service. Alternatively, the hinged faceplate panel may be secured with a conventional key lock that facilitates controlled access. Individual sliding panels may typically be removed or replaced by temporarily removing the top cover from the housing, and sliding the desired panels out of the chassis. Astragals may be removed if necessary. The removed panels may be altered or replaced as desired.

In either embodiment the faceplate structure may contain graphic or textual information, or it may support elevator operational controls, switches, indicators or the like. The configuration of the faceplates may be selectively arranged during housing installation to provide the desired display. Faceplate structure may be removed or rearranged as desired by the installer.

Thus, a primary object of the present invention is to provide a modular elevator control housing that is easily serviceable without cutting interior electrical wires.

A basic object is to lower elevator call switches.

Another basic object is to simplify the removal and replacement of elevator control housings and associated display faceplates.

An additional object is to simplify maintenance chores by facilitating service access to the interior of the housing.

Another object is to provide an elevator control housing that mounts over existing electrical boxes or fixtures without requiring the installer to cut the wall.

Yet another fundamental object is to make it easier for elevator service personnel, suppliers and operators to comply with the Americans with Disabilities Act.

Still another object of our invention is to provide an elevator control housing that easily retrofits over preexisting elevator controls without substantial modification.

A related object is to provide a replacement control housing that utilizes existing elevator control apertures while simultaneously lowering the placement of the elevator switches.

A related object is to provide a modular housing of the character described that provides an easily customized display.

Yet another basic object of the invention is to provide a modular housing that permits selective access to the interior of the housing in an efficient manner. It is a feature of both embodiments of this invention that the hinged faceplate panel may be provided with either lock access or tamper proof screw access.

Another object is to improve security. It is a feature of our invention that a key operated lock may be installed in place of a tamper proof screw.

A still further object is to provide a modular control housing of the character described designed to permit routine changing of internal lamps without completely removing all faceplate structure.

Another object is to provide a housing that accepts almost all conventional elevator controls, including direction indicating arrows, position indicators, chimes, buzzers, key switches, pilot lights, digital annunciators, push buttons and the like.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
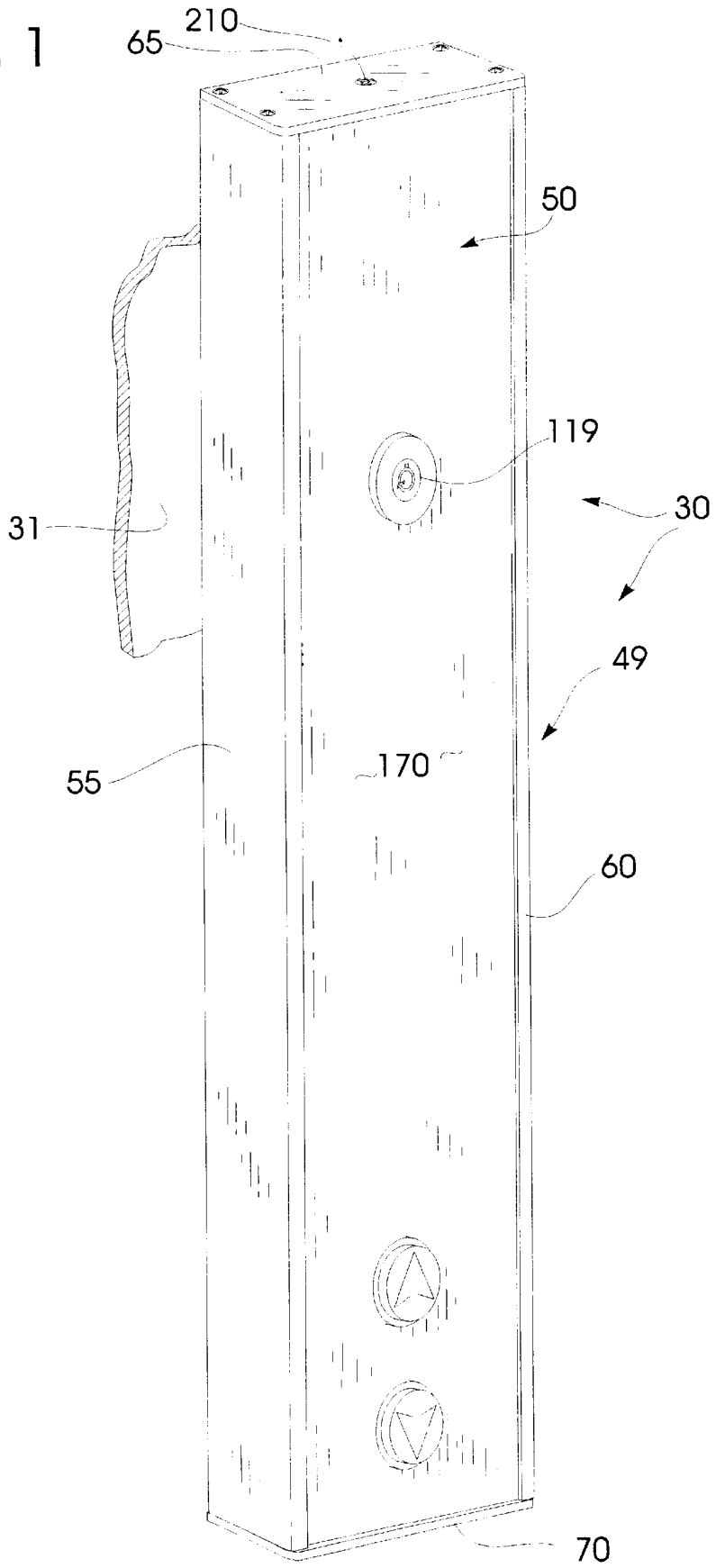
FIG. 1 is a front isometric view of a preferred control housing with a single-piece, hinged display faceplate.
Figure 2:
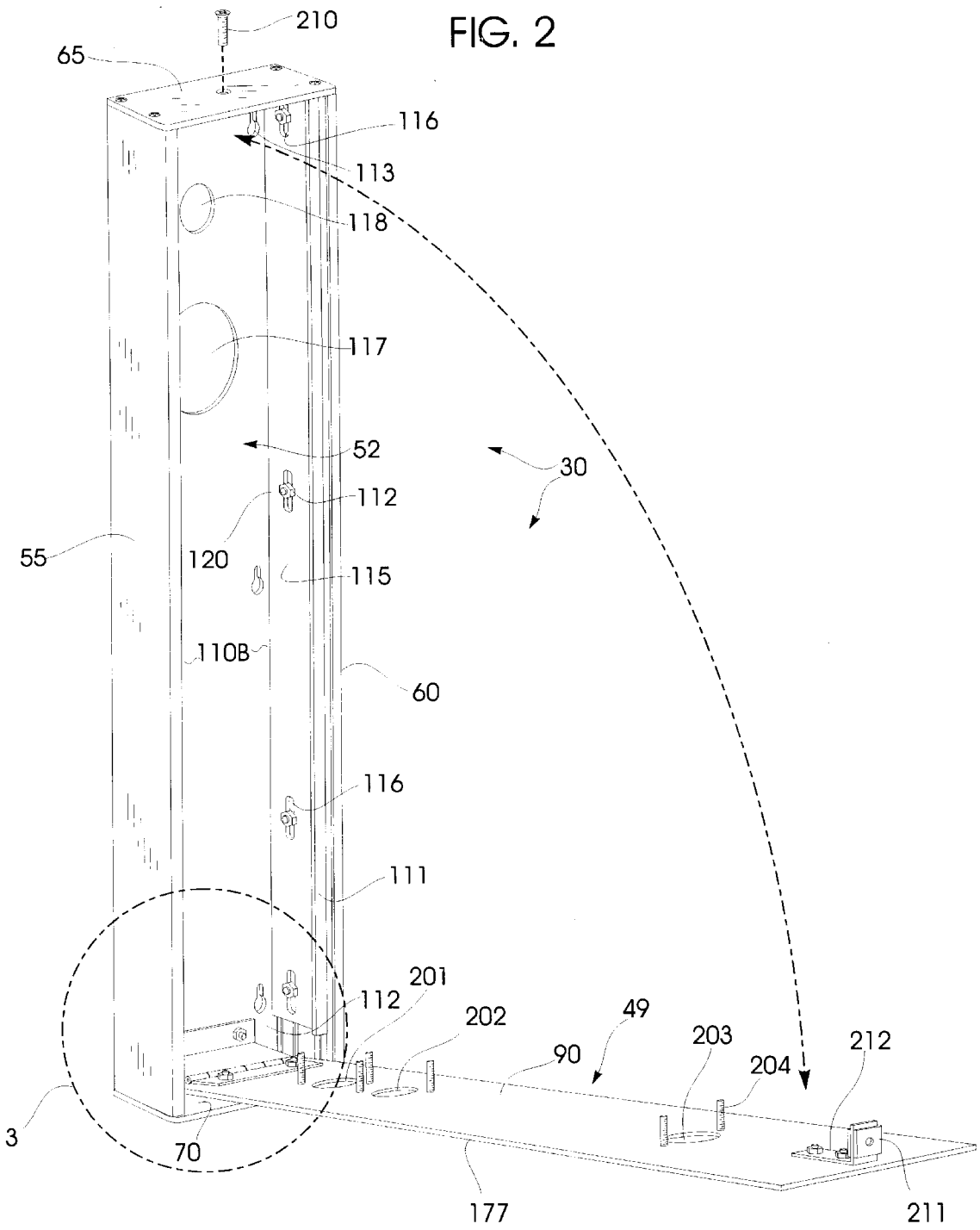
FIG. 2 is a front isometric view similar to FIG. 1, but showing an open housing whose hinged faceplate has been deployed to expose the housing interior.

With attention now to the appended drawings, the preferred embodiment of our hinged modular elevator control housing is broadly designated by the reference numeral 30 (FIGS. 1–6). An alternative design 30A is disclosed in FIGS. 5–6. (For purposes of brevity, reference numerals referring to structure that is common to both embodiments include the suffix "A"). Each housing 30, 30A comprises several modular components to be described hereinafter, many of which are easily assembled at the installation site.

Housings 30, 30A readily retrofit to existing elevator installations to replace obsolete elevator control panels. Each housing permits elevator controls or indicators to be lowered or altered without relocating original elevator control outlets. Generally the control housings are mounted adjacent conventional elevator doors, preferably upon on an adjoining wall 31, 31A. When installed they protectively cover an elevator control outlet of the type recognized by those with skill in the art. Each housing accommodates a variety of controls, including direction indicating arrows, position indicators, chimes, buzzers, key switches, pilot lights, digital annunciators, push buttons and the like.

Control housings 30 (FIG. 1) and 30A (FIG. 5) each comprise a generally rectangular, parallelepiped chassis 50, 50A respectively. Each chassis defines an interior in which suitable electrical controls, switches and the like may be housed. Chassis 50, for example, has interior 52 (FIG. 2) bounded by its sidewalls, a one-piece, hinged faceplate 49, and a top and bottom. The exterior of each chassis 50, 50A is bounded by a pair of spaced apart, vertically oriented, sidewalls that are preferably extruded from aluminum. The faceplate 49A covering chassis 50A (FIG. 5) comprises a hinged panel and one or more sliding panels as described hereinafter. Left chassis sidewalls 55, 55A and right sidewalls 60, 60A are spanned by tops 65, 65A and spaced apart bottoms 70, 70A respectively. These chassis sidewalls are secured both by the tops and bottoms and by attachment to the subframe described below.

Preferably each chassis 50, 50A comprises a subframe 110, 110A (FIGS. 4, 6) bounded by the rigid, extruded sidewalls and the tops and bottoms. Each subframe 110 or 110A secures the respective housing 30, 30A to the wall or other generally vertical supporting surface. Subframes 110, 110A (FIG. 4, 6) preferably comprise an elongated, generally rectangular base 112, 112A that has a pair of integral, upturned longitudinal, flanges forming its sides. Left subframe flanges 114 or 114A are spaced apart from and parallel with right subframe flanges 115 or 115A. Each subframe flange has an inwardly turned lip 111 coextensive with its length that is parallel with and spaced apart from the subframe base 112 or 112A.

In each case the flat subframe base is preferably secured to a flat surface (i.e., wall 31, 31A) with conventional fasteners. A series of slotted screw holes 113 (FIG. 3) are preferably defined in the base at regular, spaced apart intervals to facilitate installation. In the best mode the subframe sides comprise several regularly vertically spaced apart, ellipsoidal mounting slots 116 (FIG. 4A) or 116A (FIG. 6) that facilitate coupling to the chassis sidewalls during installation and/or assembly. The mounting slots 116, 116A facilitate attachment of the modular, extruded sidewalls. With alternative housing 30A the latter slots additionally accommodate support brackets 270 to be described later. Slots 116 are penetrated by bolts 120 that threadably receive nuts 122. The bolt 120 and nut 122 combination secures the brackets 270 and the display 219. Bolts 120 have heads 124 captivated within captivating grooves 142 (FIG. 4A) in the extruded sidewalls, as described later.

Preferably wiring orifices 118, 118A penetrate the base of the subframes. The previous wiring used for the older elevator control housing or the new wiring may be routed through orifices 118, 118A. On some models a larger orifice 117, 117A penetrates the subframe 110, 110A below orifice 118, 118A. Orifices 117, 117A allow a fireman's switch 119, 119A (or other maintenance or service switch) to mount through and into the existing electrical box. The fireman's switch overrides the controls and prevents others from using the elevator.

All chassis sidewalls 55, 55A and 60, 60A attach to the subframe flanges similarly. These extruded sidewalls are generally flat, elongated, and rectangular. Exposed exterior surfaces of the sidewalls are polished and smooth. Several parallel grooves are defined in each interior wall surface and extend along the entire length of the sidewall. A captivating groove 142 (FIGS. 3, 4A) captivates the fastener heads 124 that secure the sidewalls to the subframe side flanges. Captivating groove 142 is internally T-shaped and it slidably receives and captivates the fasteners, which are limited to slidable movements. The fasteners cannot turn as the nuts are torqued during assembly since their heads cannot rotate when registered within groove 142.

Two smaller, spaced apart parallel mounting grooves 144, 146 border groove 142 on each side. Mounting grooves 144, 146 seat and partially receive self tapping sheet metal screws 147 (FIG. 4) to secure the top 65; screws 149 (FIG. 4) likewise secure bottom 70. Screws 147 and 149 are inserted through suitable mounting holes defined near the corners of the top and bottom 65, 70 respectively.

A sliding groove 150 (FIG. 4A) extends along the front edge of the sidewalls 55, 60. The sliding groove 150 receives the longitudinal edges of the slidable faceplate panels of housing 30A to be described later. Preferably, groove throat has a rectangular cross-section. The groove 150 extends along the entire length of the sidewalls 55, 60. The cross-section of groove 150 is rectangular. Grooves 150 in opposite, facing sidewalls are parallel with one another, and aligned generally above the plane established by the lips 111 formed in the subframe side flanges.

Figure 3:
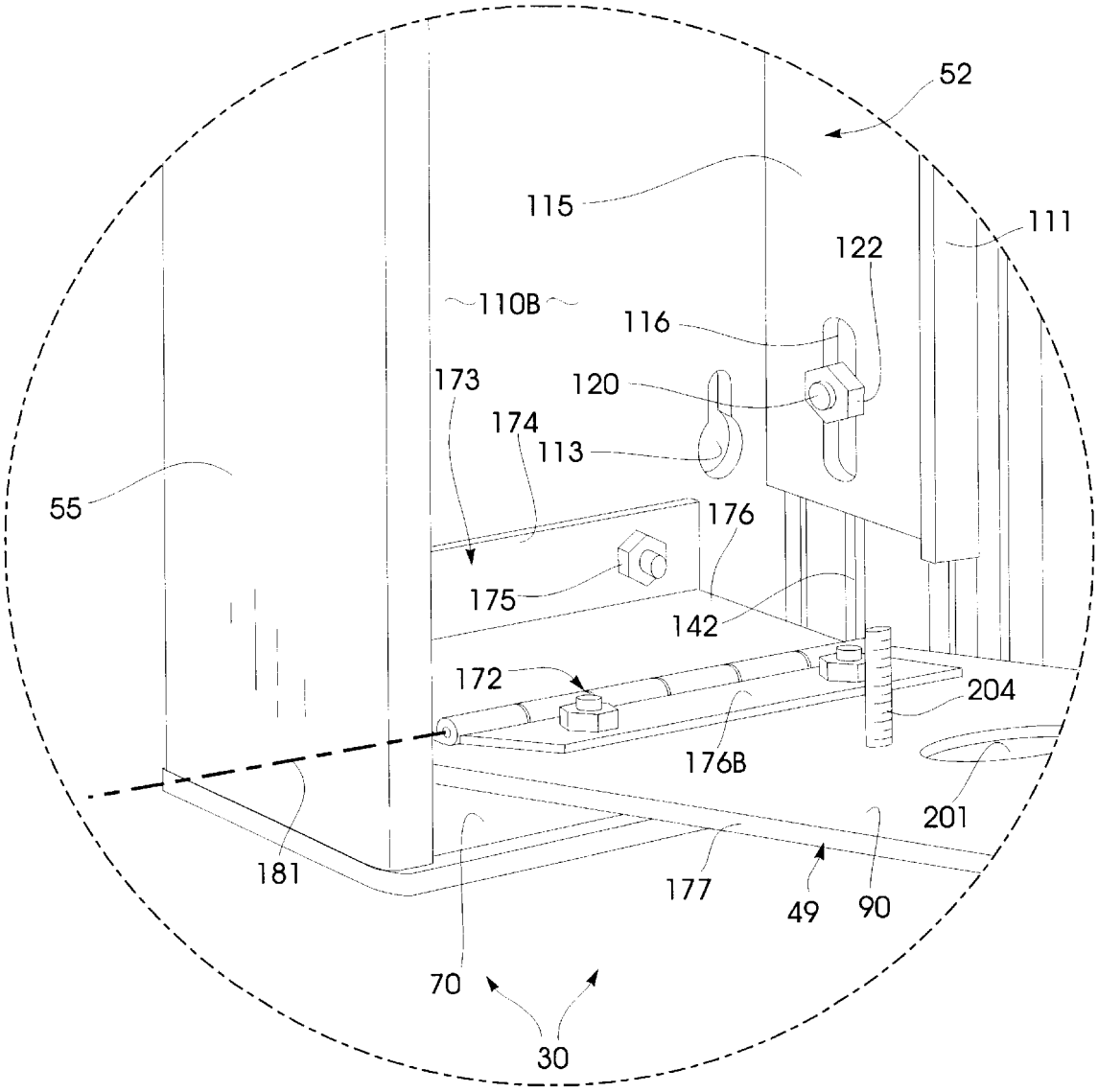
FIG. 3 is an enlarged, fragmentary front isometric view taken generally from the encircled region "3" of FIG. 2.
Figure 4:
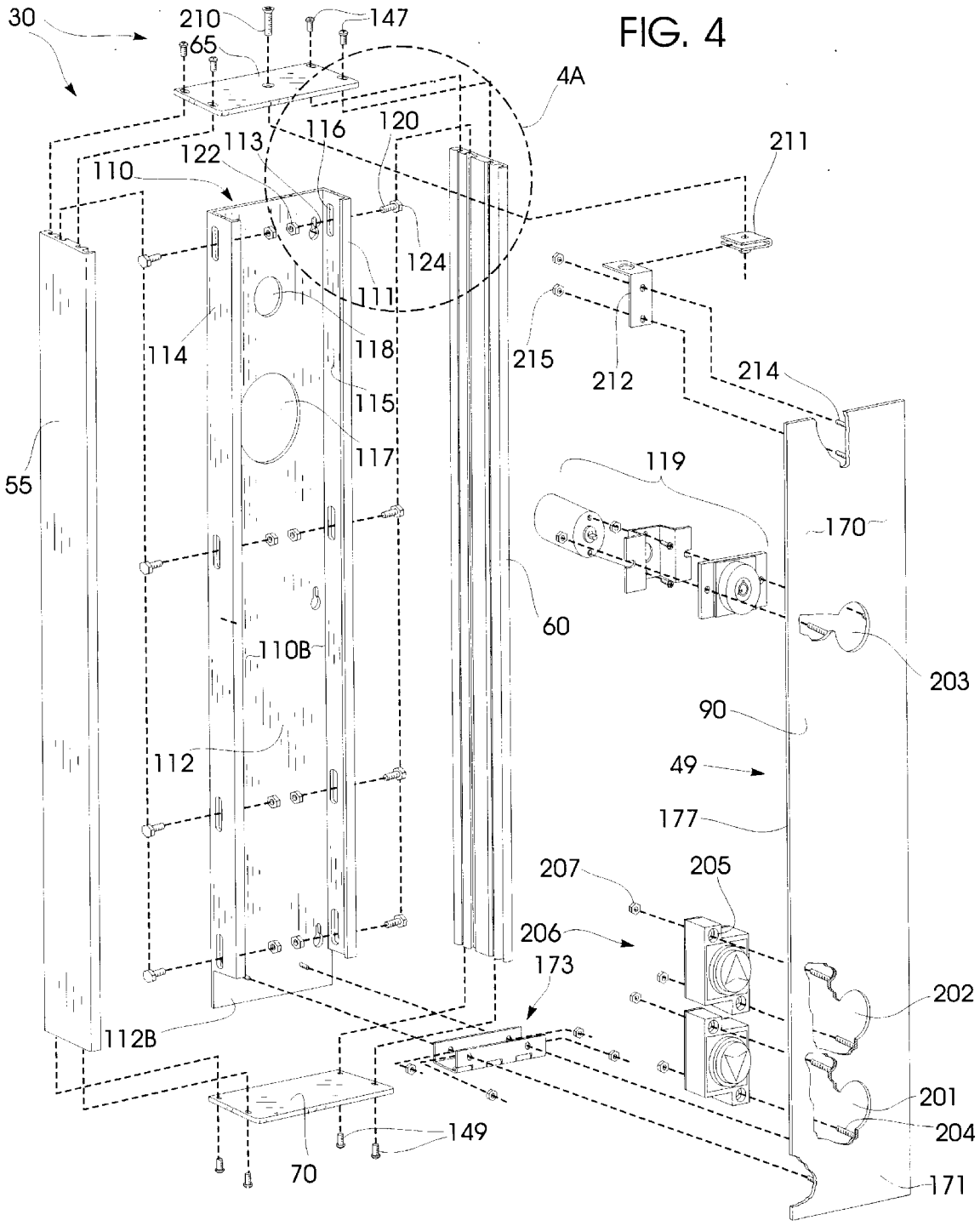
FIG. 4 is an exploded, front isometric view of the preferred control housing of FIGS. 1–3.
Figure 4A:
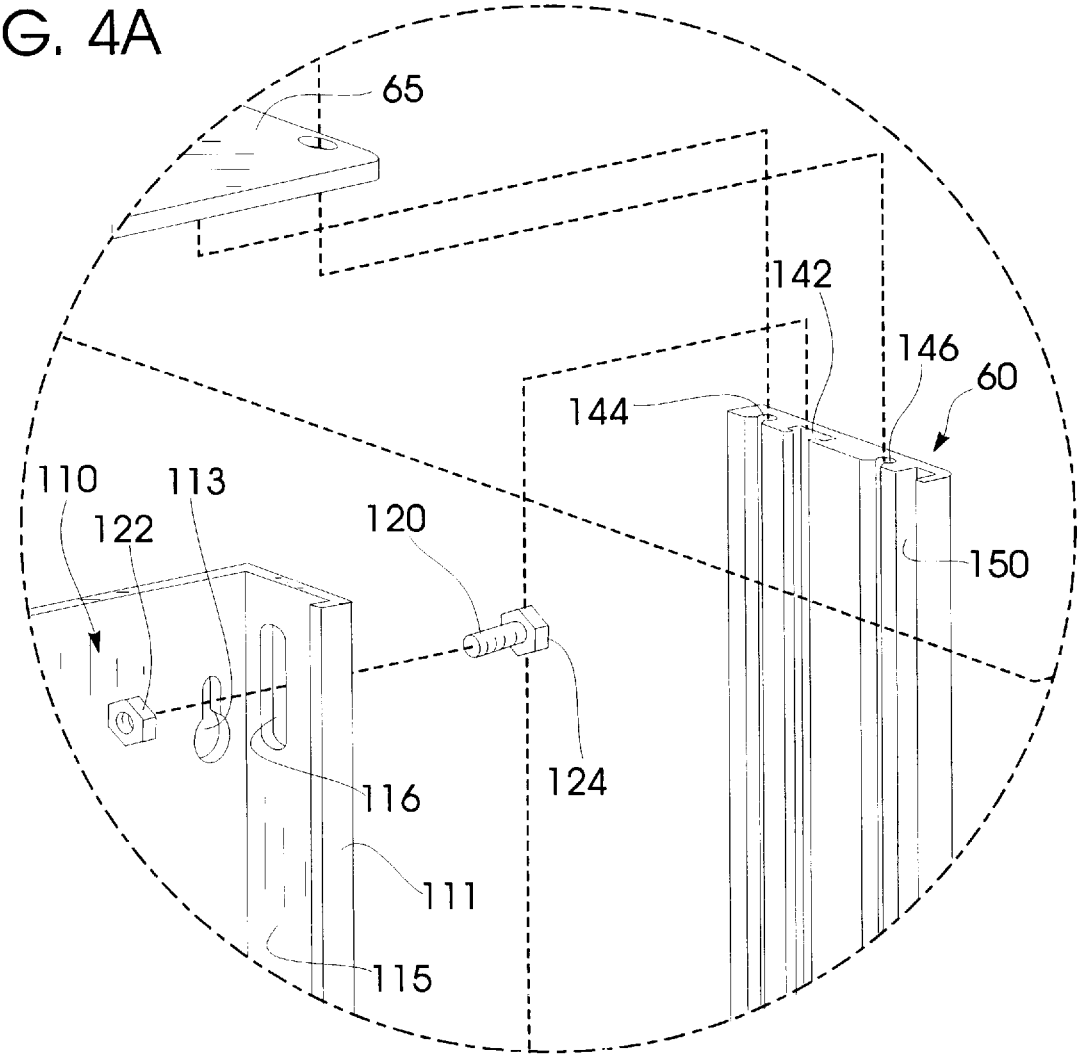
FIG. 4A is an enlarged, fragmentary front isometric view taken generally from the encircled region "4A" of FIG. 4.
Figure 5:
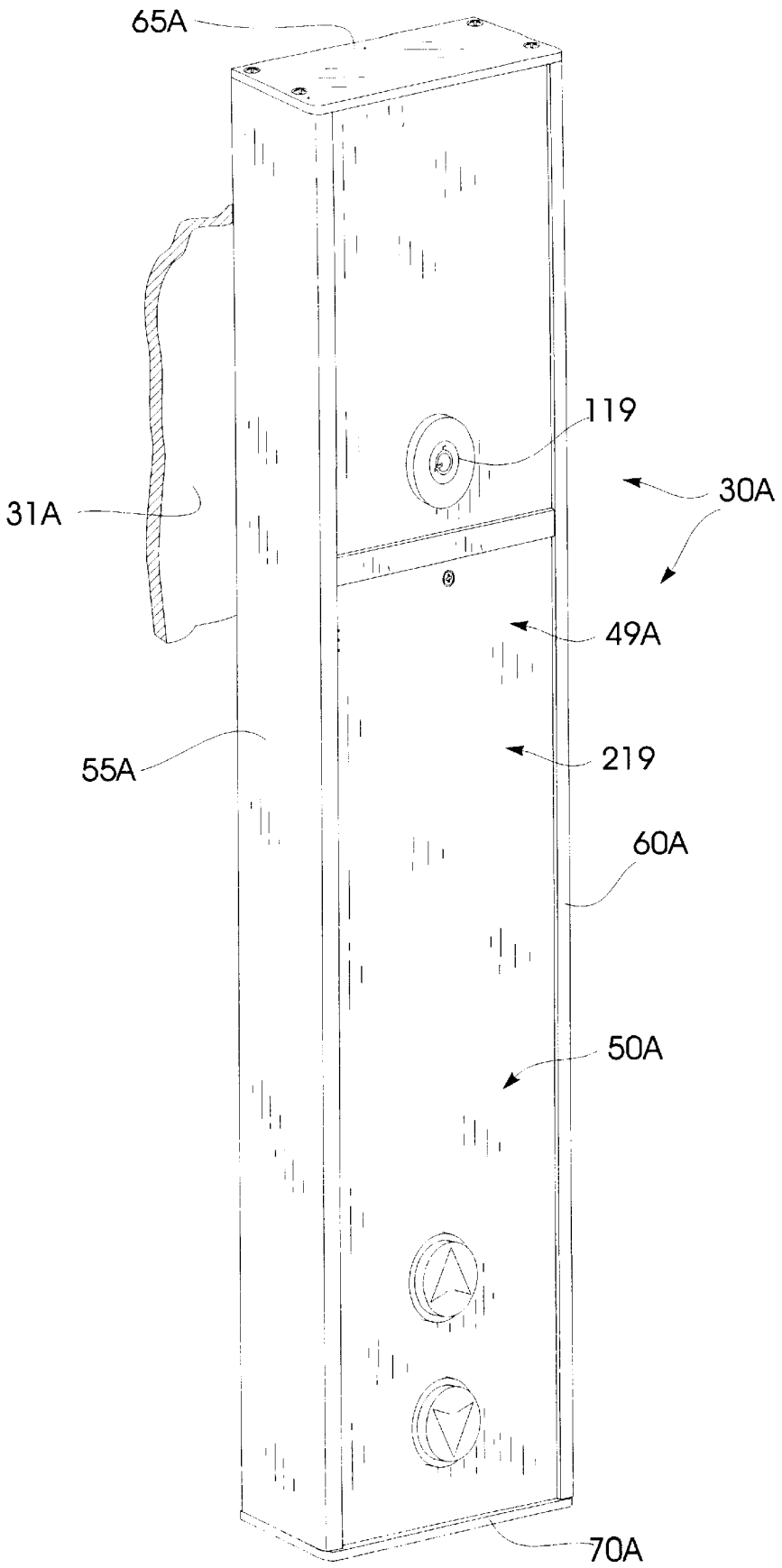
FIG. 5 is an front isometric view similar to FIG. 1, but showing an alternative housing having a multi-piece faceplate; and, FIG. 6 is an enlarged, exploded, front isometric view of the alternative housing of FIG. 5.

Housing 30 has a display faceplate 49 formed of a unitary piece of flat, rectangular metal 90. Outer faceplate surface 170 may contain written information or other designs. Of course, surface 170 could be selectively configured to support elevator operational controls as desired. The bottom 171 is coupled with fasteners 172 to a preferably offset hinge generally indicated by the reference numeral 173 (FIG. 3). Hinge 173 comprises a flat foot 174 secured by fasteners 175 to the subframe surface 110B (FIGS. 3, 4). Foot 174 is mounted above the lowermost bottom 112B (FIG. 4) of the subframe for alignment purposes. Hinge 173 comprises an integral, rectangular spacer 176 projecting from foot 174 which is perpendicular thereto. Spacer 176 offsets hinge plate 176B and the hinge axis 181 from the surface 110B of the subframe for folding purposes. The longitudinal plate edges 177 (FIGS. 3, 4) of panel 90 are generally aligned with sidewall grooves 150 when the panel 90 is flushly folded into closed position, abutting flange lips 111 of the subframe.

Thus the display faceplate 49 is hingedly coupled to the chassis. Display panel 49 has a number of mounting apertures 201–203 bounded by inwardly projecting mounting studs 204. The studs 204 penetrate suitable orifices 205 to secure desired electrical devices, such as direction indicators 206 which are centered within the mounting apertures and fastened by nuts 207 (FIG. 4). Aperture 203 permits the installation of either a conventional fireman's service control 119 or an independent service control switch.

Outer faceplate surface 170 may be marked with written information or other designs or indicia. Of course, surface 170 could be selectively configured to support elevator operational controls as desired. The longitudinal plate edges 177 are flushly aligned with the outermost edges of the sidewalls when the faceplate 90 is folded into the closed position. The offset hinge configuration prevents the bottom 171 of the faceplate from colliding with chassis structure when folding between the open and closed positions.

To open housing 30 and expose the housing screw 210 (FIG. 4) must be removed by authorized personnel. Screw 210 penetrates top 65 and threadably engages clip 211 that is held by bracket 212. Bracket 212 is mounted at the top rear of the faceplate by projecting studs 214 threadably coupled to nuts 215 (FIG. 4). Screw 210 and bracket 212 may alternatively be replaced by a conventional key lock recognized by those with skill in the art.

Figure 6:
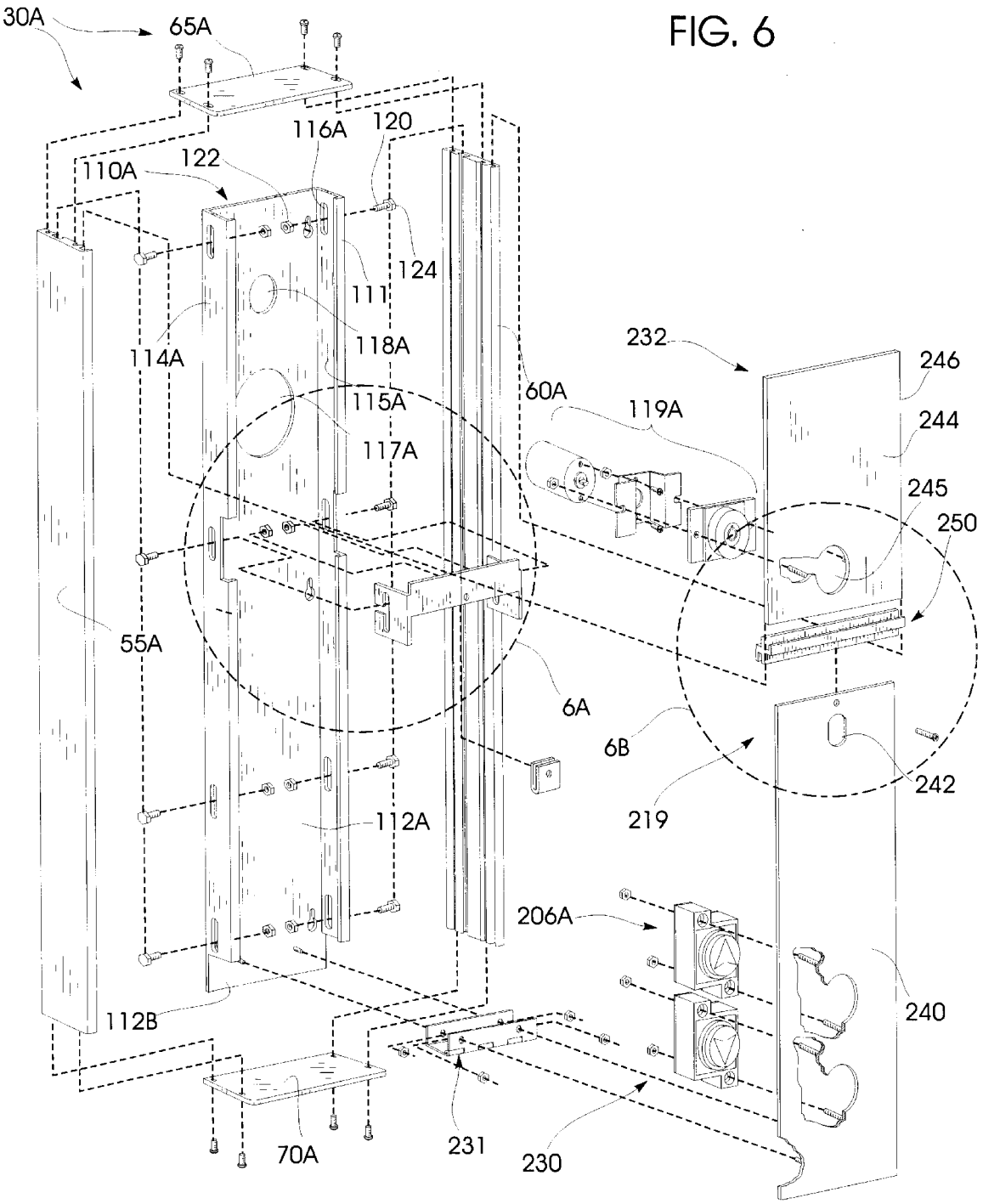
FIG. 6A is an enlarged view of the circled segment "6A" of FIG. 6; and, FIG. 6B is an enlarged view of the circled segment "6B" of FIG. 6.

The alternative housing 30A has a multipiece display faceplate 219 (FIG. 6). The multi-piece faceplate 219 comprises a hinged panel 230 and a selection of slidable faceplate panels 232. In this embodiment the faceplates are arranged and configured at the factory. The number of faceplate panels used in a particular installation depends upon the desired length and configuration of the housing 30A. As before, the panels typically support elevator operational indicators 206A or controls 119A (FIG. 6). The exact user-selectable configuration of housing 30A is not limited to a particular faceplate configuration or control selection since the faceplate panels may be easily changed to support countless variations.

The hinged display panel 240 is shorter than panel 49, but its hinge mounting structure is similar to that previously discussed. It may be provided with one or more optional mounting orifices 242 (FIGS. 6, 6B) similar to orifices 201 and 202 discussed earlier. Orifice 242, for example, could mount a key lock for opening or closing the panel. Hinge structure 231 is offset like hinge 173 (FIG. 3) to prevent collisions with the housing. Sliding panel 244, however, has opposed edges 246 that are slidably received within and constrained by sidewalls 55A, 60A. Panel 244 may have one or more mounting orifices 245. The edges of panel 244 ride within sliding groove 150 (FIG. 4A) of the sidewalls, which are exposed during assembly when top 65A is removed from the enclosure. Upper and/or lower edges of adjoining panels, however, are flushly received by an astragal 250.

Figure 6A:
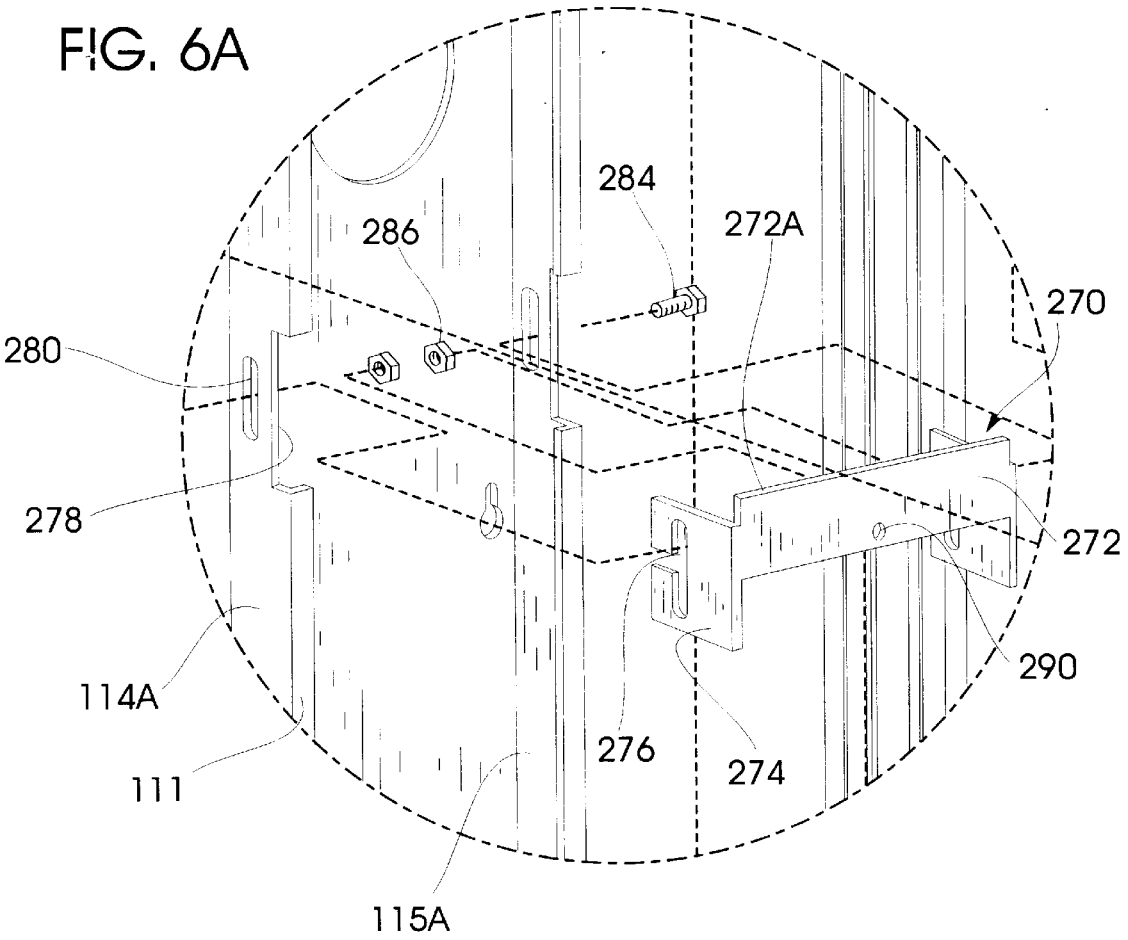
Figure 6B:
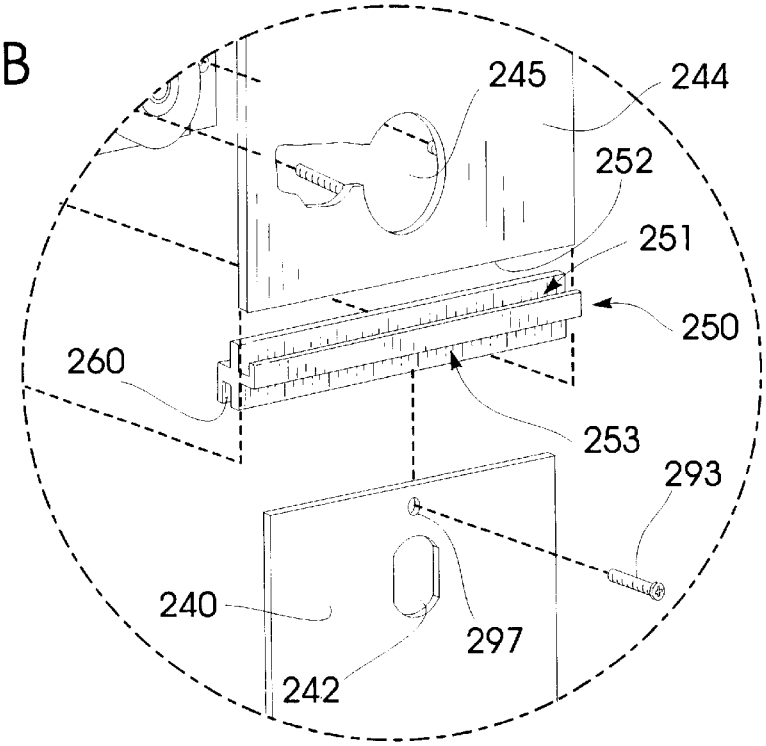

Preferably, multi-channeled astragal 250 is used to connect abutting plates FIGS. 6, 6A, 6B). Astragal 250 comprises a front, upper channel 251 that flushly receives the lower edge 252 of the upper sliding plate 244. At the astragal front an open, angled notch 253 flushly receives the top of the folding panel 240 when closed. The notch is open so the folding panel may be moved in and out without interference. An integral, spaced-apart rear channel 260 projects rearwardly into the chassis interior, parallel with the front channel 251 and notch 253.

The rear support channel 260 secures the astragal to a transverse, internal bracket 270 (FIG. 6A). A bracket front piece 272 extends integrally between a pair of similar, parallel tabs 274 that have T-shaped mounting channels 276. Special clearance notches 278 are formed in the flanges 114A, 115A of the subframe. Elongated mounting slots 280 beneath these notches are adapted to register with channels 276 for assembly. Fasteners 284 (whose heads are captivated within a sidewall groove 150 as in the previous embodiment) projects through channel 276 and slot 280, being retained by nut 286 (FIG. 6A). The vertically elongated shapes of slots 280 and channels 276 facilitate vertical alignment. Front piece 272 has an upper edge 272A received within astragal channel 260 (FIG. 6B). In assembly an orifice 290 in front piece 272 threadably receives a hex screw 293 (FIG. 6B) that penetrates orifice 297 in panel 240. When the housing 30A is assembled, the astragal channels cooperate with the sliding groove 150 in the sidewalls to restrain the sliding panels.

Installation and Interior Access

Either housing should be installed adjacent an elevator car access location to mount operational controls or indicators, and to display desired information. During replacement installations, an installer removes the old, pre-existing elevator control housing to expose the wiring outlet which is to be covered by the housing. During an initial installations, the wiring outlet is left open during construction. The installer attaches the chassis to the wall 31, 31A with the fasteners that may be screwed into new holes that are drilled as required. When the subframe 110 or 110 is in place, it substantially covers the outlet. The outlet wiring is routed through the wiring orifices so that new elevator controls may be wired. Once the elevator controls have been wired, the rest of the assembly may be attached to the subframe.

The sidewalls 55, 55A, and/or 60, 60A are installed by properly positioning the fastener heads in the sidewall groove. The sidewalls can then slide into place. With housing 30A, one or more desired slidable panels are selected, and they slide within the interior grooves 150 defined in the sidewalls. Covers cooperate with the interior grooves to secure the display therebetween. During sidewall assembly, suitable brackets 270 must be mated to the notched regions of the sidewalls as discussed (i.e., see FIG. 6A). With the top and bottom screwed into place, a secure assembly results.

It may be desirable to change or replace faceplates to accommodate changing regulations or building remodeling. It may also be desirable to access the housing interior. The hinged faceplate panels may be simply unlocked by authorized personnel to service the interior of the housings 30, 30A without substantial disassembly. In the preferred embodiments, the top is selectively removed to remove a sliding panel. The faceplates may be replaced as desired to impart a different "look" to the housing.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A modular control housing adapted to be mounted adjacent an elevator, said housing comprising:

a generally rectangular subframe for mounting upon a supporting surface, said subframe having opposed side flanges;

a pair of generally rectangular, spaced apart, modular sidewalls adapted to be secured to said subframe side flanges;

elongated, interior captivating grooves defined in each sidewall;

fastener means slidably captivated within said captivating grooves for engaging said subframe side flanges to secure said sidewalls;

a housing top extending between said sidewalls;

a housing bottom extending between said sidewalls;

at least one generally planar faceplate secured to the housing between said sidewalls and displaceable between open and closed positions;

offset hinge means for mounting said faceplate; and, at least one elevator control comprising a switch, display, indicator or the like accessible through or disposed upon said faceplate.

2. The housing as defined in claim 1 wherein said sidewalls comprise mounting grooves parallel with said captivating grooves, said mounting grooves seating fasteners for mounting said top and said bottom.

3. The housing as defined in claim 1 wherein said faceplate comprises a hinged panel and at least one separate slidable panel.

4. The housing as defined in claim 3 wherein said sidewalls comprise elongated slidable grooves, and said at least one slidable panel is captivated between said slidable grooves and extends between said sidewalls.

5. The housing as defined in claim 4 wherein said housing comprises at least one astragal for receiving adjoining edges of said faceplate panels.

6. The housing as defined in claim 5 wherein said astragal comprises:

an upper channel for captivating an adjoining edge of said slidable faceplate panel; and, a notch for receiving an adjoining edge of said hinged faceplate panel.

7. The housing as defined in claim 6 wherein said housing comprises an internal bracket for securing each astragal.

8. The housing as defined in claim 7 wherein said sidewalls comprise mounting grooves parallel with said captivating grooves, said mounting grooves seating fasteners for mounting said top and said bottom.

9. A control housing adapted to be mounted adjacent an elevator, said housing comprising:

a generally rectangular subframe for mounting upon a supporting surface, said subframe having opposed side flanges;

a pair of generally rectangular, spaced apart, modular sidewalls adapted to be secured to said subframe;

elongated, interior captivating grooves defined in each sidewall;

fastener means slidably captivated within said captivating grooves for engaging said subframe to adjustably secure said sidewalls thereto;

a housing top extending between said sidewalls;

a housing bottom extending between said sidewalls;

a faceplate disposed upon said chassis and foldable between open and closed positions;

hinge means for mounting the faceplate; and, lips defined on said subframe for abutting said faceplate when it is disposed in said closed position.

10. The housing as defined in claim 9 wherein:

said faceplate comprises a hinged panel and at least one separate slidable panel;

said sidewalls comprise elongated slidable grooves parallel with said captivating grooves; and, said at least one slidable panel is captivated between said slidable grooves and extends between said sidewalls.

11. The housing as defined in claim 10 wherein said housing comprises at least one astragal for receiving adjoining edges of said faceplate panels, said at least one astragal comprising:

an upper channel for captivating an adjoining edge of said slidable faceplate panel; and, an outer notch for receiving an adjoining edge of said hinged faceplate panel.

12. The housing as defined in claim 11 wherein said housing comprises an internal bracket for securing each astragal.

13. The housing as defined in claim 12 wherein said astragal has an inner channel, and said internal bracket comprises a portion that engages said astragal inner channel interiorly of said housing.

14. The housing as defined in claim 13 wherein said sidewalls comprise mounting grooves parallel with said captivating grooves, said mounting grooves seating fasteners for mounting said top and said bottom.

15. A control housing adapted to be mounted adjacent to an elevator, said housing comprising:

an exteriorly accessible interior;

a subframe secured to a supporting surface adjacent the elevator, said subframe comprising a generally planar, apertured base and a pair of spaced apart side flanges;

a spaced apart, elongated sidewall secured to each of said subframe side flanges, each of sidewalls comprising elongated mounting grooves and elongated captivating grooves;

fastener means slidably captivated within said captivating grooves of said sidewalls for mounting said sidewalls to said subframe;

a top extending between said sidewall tops and secured thereto by fasteners seated within said mounting grooves;

a bottom extending between said sidewall bottoms and secured by fasteners seated within said mounting grooves;

a faceplate mounted upon said chassis and foldable between an open position exposing said interior and a closed position enclosing said interior; and, offset hinge means for mounting said faceplate so it can fold to an open position without colliding with the housing.

16. The housing as defined in claim 15 wherein said faceplate comprises a separate hinged panel, at least one separate, adjoining sliding panel, and an astragal for receiving adjoining edges of the faceplate panels.

17. The housing as defined in claim 16 wherein said side flanges comprise lips for abutting said separate hinged panel when disposed in said closed position.

18. The housing as defined in claim 16 wherein:

said sidewalls comprise elongated slidable grooves parallel with said captivating grooves; and, said at least one slidable panel is captivated between said slidable grooves and extends between said sidewalls.

19. The housing as defined in claim 18 wherein said housing comprises:

at least one astragal for receiving adjoining edges of said faceplate panels, said at least one astragal comprising an upper, outer channel for captivating an adjoining edge of said slidable faceplate panel, an outer notch for receiving an adjoining edge of said hinged faceplate panel, and an inner channel;

an internal bracket for securing each astragal, said bracket comprising a portion that engages said astragal inner channel interiorly of said housing.

20. The housing as defined in claim 19 wherein said bracket comprises mounting slot means for adjustably securing it between said sides.

* * * * *